US012686425B2

(12) United States Patent
Kirchner et al.

(10) Patent No.: US 12,686,425 B2
(45) Date of Patent: Jul. 21, 2026

(54) WAYSIDE DEVICE MONITORING SYSTEM AND METHOD

(71) Applicant: Transportation IP Holdings, LLC, Norwalk, CT (US)

(72) Inventors: Mike Kirchner, Wilmerding, PA (US); Brad Von Tersch, Jacksonville, FL (US); Chad Dietrich, Prescott, WI (US); Ralph Young, Osawatomie, KS (US)

(73) Assignee: Transportation IP Holdings, LLC, Norwalk, CT (US)

( * ) Notice: Subject to any disclaimer, the term of this patent is extended or adjusted under 35 U.S.C. 154(b) by 113 days.

(21) Appl. No.: 18/402,920

(22) Filed: Jan. 3, 2024

(65) Prior Publication Data

US 2024/0262402 A1 Aug. 8, 2024

Related U.S. Application Data

(60) Provisional application No. 63/443,575, filed on Feb. 6, 2023.

(51) Int. Cl.
*B61L 29/08* (2006.01)
*B61L 25/02* (2006.01)

(52) U.S. Cl.
CPC ..... *B61L 29/08* (2013.01); *B61L 25/02* (2013.01)

(58) Field of Classification Search
CPC ..... B61L 29/08; B61L 25/02
See application file for complete search history.

(56) References Cited

U.S. PATENT DOCUMENTS 5,760,709 A * 6/1998 Hayashi ..... G07B 15/063 455/67.7
6,401,027 B1 * 6/2002 Xu ..... G08G 1/096716 701/414
8,463,540 B2 * 6/2013 Hannah ..... H02K 7/1846 701/472
2004/0192331 A1 * 9/2004 Gorday ..... H04W 4/14 455/414.1
2014/0346284 A1 * 11/2014 Fries ..... B61L 13/00 246/125
2014/0350767 A1 * 11/2014 Fries ..... B61L 25/021 701/119
2014/0361126 A1 * 12/2014 Steffen ..... B61L 29/32 246/473.1
2016/0039439 A1 * 2/2016 Fahmy ..... B61L 15/0081 701/20
2017/0366614 A1 * 12/2017 Koravadi ..... G05D 1/0022

* cited by examiner

*Primary Examiner* — Gertrude Arthur Jeanglaude
(74) *Attorney, Agent, or Firm* — K&L Gates LLP

(57) ABSTRACT

A wayside device monitoring system is provided that may include wayside equipment control movement of vehicle systems through a segment of a route and/or monitor operation of the vehicle systems. The wayside equipment can record data indicative of the movement that is controlled the operation that is monitored. The monitoring system also can include a communication device coupled with the wayside equipment. The communication device can communicate the data recorded by the wayside equipment to at least one of the vehicle systems as the at least one of the vehicle systems move by the wayside equipment.

20 Claims, 2 Drawing Sheets

WAYSIDE DEVICE MONITORING SYSTEM AND METHOD

CROSS-REFERENCE TO RELATED APPLICATIONS

This application claims priority to U.S. Provisional Application No. 63/443,575 (filed 6 Feb. 2023), the entire disclosure of which is incorporated herein by reference.

BACKGROUND

Technical Field

The subject matter described herein relates to systems and methods that monitor wayside devices.

Discussion of Art

Some wayside devices operate to ensure safe travel of vehicle systems, and other wayside devices operate to monitor operation of the vehicle systems. For example, wayside devices at intersections (e.g., crossings or other intersections) between routes may monitor operation of gates, signals, or the like, that operate to safely control and limit passage of the vehicle systems to and through the intersections. Other wayside devices may include sensors that sense one or more characteristics of the vehicle systems (e.g., hot box detectors, cameras, etc.) and/or the surrounding environment.

These wayside devices may record data related to or generated from the operation of the wayside devices. In some instances, the wayside devices may have a consistent connection to a communication network or may have the ability to connect to a communication network on demand. But, some wayside devices may have no connection to any communication network, or may not be able to connect to any such communication network on demand. For example, some wayside devices at remotely located intersections may not have a network connection due to the lack of surrounding infrastructure.

With respect to intersections that are crossings between rail tracks or between rail tracks and roads, wayside devices may be present that monitor operation of crossing circuits at or near the crossings, that monitor operation of gates or signals, etc. Data associated with functionality (or a lack thereof) of the circuits, gates, signals, etc. may be recorded by the wayside devices. But for those wayside devices that do not have a consistent connection to a communication network (e.g., a Wide Area Network, or WAN; the Internet; etc.), there may not be regular or easy communication of this data to other locations. As a result, an operator may need to travel to the location of the wayside device, physically connect a data recorder of the wayside device with a computer carried by the operator, download the data from the data recorder of the wayside device to the operator computer, and then return to a remote location having a communication network connection to upload the data to other systems, such as a back office of a Positive Train Control (PTC) system.

Because some intersections may be very far from operator locations, however, long periods of time may pass between travels of operators to the remotely located wayside devices. During the time periods between downloading of the data from the wayside devices, failure or deterioration of the wayside devices may occur such that the wayside locations may become unsafe for travel. But these issues may not be detected for extended periods of time, thereby exposing vehicle systems traveling to and through the intersections to potentially unsafe conditions.

For example, approximately 95% of railroad grade crossings in the United States may not have a wide area network connection. The devices which control these waysides can produce valuable data that can be useful in maintaining the systems. Currently, someone may need to drive to the location and connect an Ethernet cable to the device to review this data. This can be a time-consuming and laborious process to collect the data.

It may be desirable to have a system and method that differs from those that are currently available.

BRIEF DESCRIPTION

In one example, a wayside device monitoring system is provided that may include wayside equipment control movement of vehicle systems through a segment of a route and/or monitor operation of the vehicle systems. The wayside equipment can record data indicative of the one or more of controlling movement of the vehicle systems or monitoring operation of the vehicle systems. The monitoring system also can include a communication device coupled with the wayside equipment. The communication device can communicate the data recorded by the wayside equipment to at least one of the vehicle systems as the at least one of the vehicle systems move by the wayside equipment.

In another example, a method for monitoring operation of a wayside device is provided. The method may include recording data obtained by wayside equipment (of the wayside device) that one or more of controls movement of vehicle systems through a segment of a route and/or monitors operation of the vehicle systems. The data that is recorded can indicate the one or more of controlling movement of the vehicle systems and/or monitoring operation of the vehicle systems. The method also may include communicating the data recorded by the wayside equipment to at least one of the vehicle systems as the at least one of the vehicle systems move by the wayside equipment.

In another example, a wayside device is provided that may include a gate that can be raised or lowered to control access of vehicle systems to move through an intersection between routes, a data recorder that may store data indicative of times at which the gate is raised or lowered, and a communication device that may wirelessly communicate the data to a remotely located PTC back office system by wirelessly communicating the data to at least one of the vehicle systems while the at least one of the vehicle systems moves through the intersection.

BRIEF DESCRIPTION OF THE DRAWINGS

The subject matter may be understood from reading the following description of non-limiting embodiments, with reference to the attached drawings, wherein below.

DETAILED DESCRIPTION

Embodiments of the subject matter described herein relate to systems and methods that allow for the communication or acquisition of data from devices that may not have regular or consistent connections to communication networks, as well as the communication and/or use of that data to or by other systems for diagnosis of the devices, control of the devices, control of other systems, etc. In one example, the system and methods may use already installed PTC system components onboard many, if not almost all, rail vehicle systems traveling in the United States. These vehicle systems may have a WiFi interface which is used to upload the data obtained from wayside devices once the vehicle systems reach a vehicle yard (e.g., rail yard) or other location that has a consistent or reliable connection to a communication network (e.g., a WAN such as the Internet). The system may include a communication device such as a WiFi access point at the wayside device on a data recorder. This communication device can allow the communication device onboard the vehicle system (e.g., the WiFi interface) to connect to the data recorder and upload the data of the wayside device to the vehicle system. The vehicle system then moves that data over the existing upload interface to the back office prior to reaching a vehicle yard or upon arriving at the vehicle yard. Optionally, a communication device that includes a WAN circuit or a modem plus a cellular subscription, both of which may have recurring costs, may be installed at the wayside device to allow the wayside device to upload the data to the PTC system without having to first communicate the data to the vehicle system.

While one or more embodiments are described in connection with a rail vehicle system, not all embodiments are limited to rail vehicle systems. Unless expressly disclaimed or stated otherwise, the subject matter described herein extends to other types of vehicle systems, such as automobiles, trucks (with or without trailers), buses, marine vessels, aircraft, mining vehicles, agricultural vehicles, or other off-highway vehicles. The vehicle systems described herein (rail vehicle systems or other vehicle systems that do not travel on rails or tracks) may be formed from a single vehicle or multiple vehicles. With respect to multi-vehicle systems, the vehicles may be mechanically coupled with each other (e.g., by couplers) or logically coupled but not mechanically coupled. For example, vehicles may be logically but not mechanically coupled when the separate vehicles communicate with each other to coordinate movements of the vehicles with each other so that the vehicles travel together (e.g., as a convoy).

Figure 1:
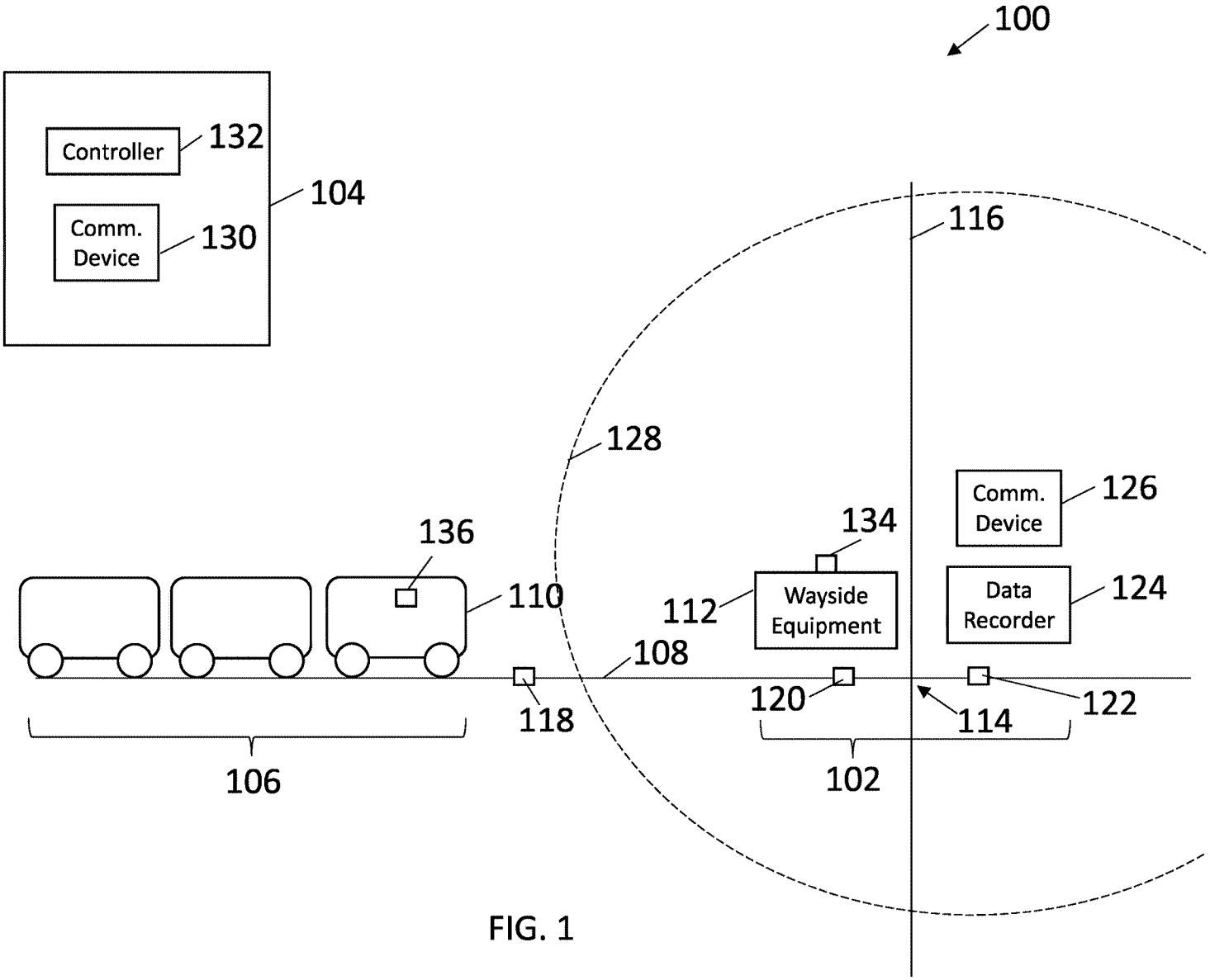
FIG. 1 illustrates one example of a monitoring system.

FIG. 1 illustrates one example of a wayside device monitoring system 100. The monitoring system can allow for data to be collected by a wayside device 102 and communicated to a remote system 104 that is remotely located from the wayside device via one or more vehicle systems 106. In one example, the remote system may be a back office system of a PTC system, a dispatch facility, a vehicle yard, or another system that monitors operation of one or more wayside devices. The wayside device can represent equipment installed alongside a route 108 to support operations, safety, and/or control of vehicle systems.

The vehicle system can represent a single vehicle 110 or two or more vehicles traveling together along one or more routes. With respect to the two or more vehicles, the vehicles in the vehicle system may be mechanically coupled with each other (e.g., by couplers, hitches, etc.), or may be mechanically separate but logically coupled with each other in that the vehicles communicate with each other to travel along the route(s) together as a convoy, platoon, or the like. The vehicle system can include one or more propulsion-generating vehicles capable of propelling themselves (e.g., locomotives, automobiles, trucks, buses, etc.) and optionally one or more non-propulsion-generating vehicles that are incapable of propelling themselves (e.g., rail cars, trailers, etc.).

The wayside device can include wayside equipment 112 that performs one or more operations. One example of wayside equipment can include a crossing gate that raises or lowers to prevent or allow vehicle systems to enter and pass by or through a wayside location or area 114. In one example, the wayside location or area is or includes an intersection between the route and at least one other route 116. The intersection may be between routes of the same type (e.g., two or more rail tracks, two or more roads, etc.) or between routes of different types (e.g., a rail track and a road). Different types of routes may indicate which vehicle systems can travel on a route. A route of a first type (e.g., a rail route) may be traveled upon by rail vehicles, but not automobiles, trucks, etc. A route of a second type (e.g., a road) may be traveled up on by automobiles, trucks, etc., but not rail vehicles. Alternatively, the wayside location may not include an intersection or crossing but may be the location of a wayside device that is not at or near an intersection or crossing.

Another example of wayside equipment can include a signal that indicates (e.g. using light generated by one or more lamps, audible sounds, etc.) a status of the route to the vehicle systems. This status can indicate whether the segment of the route ahead (e.g., downstream of the wayside device along the direction of movement of the vehicle system) is clear, occupied, or restricted.

Another example of wayside equipment can include a switch or switch point. These types of equipment may be disposed at an intersection and can control the direction that vehicle systems move while passing through the intersection. For example, in a first state or condition, a switch or switch point may cause a vehicle system traversing or traveling over the switch or switch point to stay on the route 108 and not enter onto the route 116. In different, second state or condition, the same switch or switch point may cause the vehicle system traversing or traveling over the switch or switch point to move from the route 108 to the other route 116.

Another example of wayside equipment can include a detection system that determines the location and/or movement of vehicle systems on the routes. These types of wayside equipment can detect the presence of vehicle systems, the direction in which the vehicle systems are moving, unique identities or identifiers of the vehicle systems, etc.

Another example of wayside equipment can include a travel interruption device. These types of wayside equipment can operate to intentionally or purposefully move a vehicle system off of the route, such as by derailing a rail vehicle system, moving the vehicle system onto a siding or other route, etc.

Another example of wayside equipment can include a route circuit that includes one or more electrical circuits that detect the presence of a vehicle system on a segment of the route. These types of equipment can detect the presence of the vehicle system responsive to the wheels, axles, chassis, etc. of the vehicle system creating a short across parallel rails of the route.

Another example of wayside equipment can include one or more sensors that sense characteristics of the vehicle system and/or surrounding environment. For example, the wayside equipment can include a hot box detector, a speed sensor measuring how fast the vehicle system is moving, a camera that detects and/or identifies the vehicle system, ambient temperatures, ambient pressures, humidities, etc.

In the illustrated example, the wayside equipment can represent a crossing gate that detects the approach, passage through, and/or exit of a vehicle system through the intersection. The wayside equipment can include or be connected with route circuits 118, 120, 122 that are shunted or short circuited responsive to passage of a vehicle system over or through the corresponding circuits. Detection of this short or shunt can be recorded by a data recorder 124 of the wayside device. For example, the wayside equipment can include or represent hardware circuitry that includes and/or is connected with one or more processors (e.g., one or more microprocessors, field programmable gate arrays, integrated circuits, etc.) that perform the operations described herein in connection with the wayside device. These processors can detect the short or shunt and send a signal to the data recorder to record data in a tangible and non-transitory computer readable memory (e.g., a computer hard drive, such as a solid state drive, computer disk, flash memory, magnetic disk, hard drive, etc.).

The wayside equipment can obtain and/or generate the data that is stored by the data recorder. For example, the wayside device can detect the presence of the vehicle system using the route circuits, can identify the vehicle system by communicating with the vehicle system (to obtain a unique identifier or road number associated with the vehicle system), and/or can determine the time(s) at which the circuits detect the vehicle system. These times can indicate when the vehicle system approaches the intersection by passage of the vehicle system over the approaching circuit 118, when the vehicle system enters the intersection by passage of the vehicle system over the first island circuit 120, and/or when the vehicle system leaves the intersection by passage of the end of the vehicle system over the second island circuit 122.

The wayside equipment can include or represent a gate or other object that lowers or raises to prevent vehicle systems from crossing or entering the intersection while another vehicle system approaches and/or is passing through the intersection. The wayside equipment (e.g., the processor(s)) can direct the data recorder to record data indicative of whether the gate is properly operating (e.g., the gate lowers or raises on command), whether the gate is not properly operating (e.g., the gate does not lower or raise on command), or the like. Optionally, the wayside device can record other data, such as the times at which the signal is activated, the duration that the signal is activated, the color of the light generated by the signal, whether the signal was or was not activated upon command by the processor(s), the state or condition of the switch or switch point at different times, times at which the switch or switch point changes state or condition, the detection of vehicle systems, the identities of the vehicle systems, the directions of movement of the vehicle systems, the speeds of the vehicle systems, the state of the traffic interruption device, the time at which the traffic interruption device is activated to change movement of a vehicle system, the sensed characteristics of the vehicle system, the sensed characteristics of the environment, etc.

The wayside device may include or be connected with a communication device 126 that can wirelessly communicate with one or more other communication devices. The communication device can represent transceiving circuitry, such as one or more antennas, modems, or the like. The communication device can represent a WiFi or other wireless access point that allows the wayside device to communicate with the vehicle systems passing through the intersection or passing by the wayside device. Optionally, the communication device can represent a radio transceiver, a cellular transceiver, a BLUETOOTH transceiver, a ZIGBEE transceiver, a Near Field Communication (NFC) interrogator or receiver, a radio frequency identification (RFID) interrogator or receiver, or the like.

The communication device can be retrofit or retrofitted to the wayside device. For example, the communication device can be added to a pre-existing or previously installed wayside device and/or data recorder to permit communication of data between the wayside device or data recorder and the vehicle system(s). For example, the communication device can be taken to and connected with a data recorder of a wayside device that previously was operating as described herein, but where the wayside device previously was unable, not configured, or incapable of wirelessly communicating data prior to installation of the communication device.

The wayside equipment can record the data as the vehicle systems pass by the wayside equipment, and then wirelessly communicate the data to one or more of the vehicle systems as the vehicle systems pass by the wayside equipment. For example, instead of waiting for an operator to drive to the wayside device to connect to and download the data from the data recorder, the wayside device can wirelessly communicate the data to one or more of the vehicle systems passing through or near (e.g., within a wireless communication range of) the wayside device. The communication device of the wayside device may be unable to communicate the data directly to the remote system due to the remote system being farther from the wayside device than a wireless communication range of the communication device of the wayside device. Instead, the wayside device communicates the data to the vehicle system(s) passing within a communication range 128 of the communication device of the wayside device.

The vehicle system(s) receiving this data may pass through the intersection or section of the route that is monitored or controlled by the wayside device. Optionally, the vehicle system(s) receiving the data from the wayside device may not pass through the intersection or section of the route that is monitored or controlled by the wayside device but may pass close enough to the wayside device (e.g., on a nearby route) to receive the data.

The vehicle system(s) may include communication devices that can receive the wayside device data. These vehicle system(s) may then communicate the data to the remote system. For example, the remote system may include a communication device 130 that represents wireless transceiving hardware for communicating with the vehicle system(s). The remote system may include a controller 132 (e.g., a remote system controller) that represents hardware circuitry including and/or connected with one or more processors that operate as described herein in connection with the remote system. Once the vehicle systems move to within a communication range of the remote system, the vehicle systems can communicate the wayside device data to the remote system. The remote system may be a PTC back office system having regular communication abilities with the vehicle systems, but not with the wayside devices. The vehicle systems may be able to communicate with the PTC back office system once the vehicle systems receive the data from the wayside device. Optionally, the vehicle systems can communicate the data to the remote system once the vehicle systems return to a wired network connection with the remote system, such as in a vehicle yard.

This can allow for the data collected or generated by the wayside device to be communicated to the remote system on a more regular basis than currently known wayside devices. If a fault, deterioration, or failure arises with operation of the wayside device, the data indicative of the fault, deterioration, or failure may be communicated to the remote system sooner than if the data was communicated only when an operator drives to the wayside device, downloads the data, returns to the remote system, and uploads the data to the remote system.

The remote system may include or represent hardware circuitry having or connected with one or more processors that examine the data from the wayside device. The remote system can examine the data to evaluate the state of the wayside device and, if needed, implement one or more responsive actions. For example, the remote system may examine the data and determine that the wayside equipment is not operating correctly. The remote system may send an operator to repair or inspect the wayside equipment responsive to determining that the wayside equipment is not operating correctly. Alternatively, the communication device of the wayside device may include a cellular transceiver that allows the wayside device to communicate the data to the remote system without passing the data to the remote system via one or more of the vehicle systems first.

The data optionally may be examined by the remote system to recreate or evaluate one or more events occurring in connection with the wayside device. For example, the data containing the times at which vehicle systems entered into and/or passed through the intersection, the times at which the gates lowered or raised (or did not move), etc., may be used to recreate the events leading up to and/or following a collision or other accident at or near the intersection.

The entirety of the data communicated from the wayside device to the remote system via the vehicle system(s) may not be communicated to only a single vehicle or a single vehicle system before being forwarded to the remote system. For example, the size of the data to be communicated to the remote system may be too large and/or the bandwidth of the wireless connection between the wayside device and the vehicle system(s) may be too limited to permit all of the data being communicated to the remote system to be communicated to a single vehicle system passing the wayside device. Instead, different portions or segments of the data may be communicated to different vehicles or different vehicle systems. For example, a first portion of the data stored in the data recorder may be communicated to a first vehicle of a vehicle system, a second portion of the data stored in the data recorder may be communicated to a second vehicle in the same vehicle system, and so on. As another example, a first portion of the data stored in the data recorder may be communicated to a first vehicle system, a second portion of the data stored in the data recorder may be communicated to a second vehicle system (that is separate from the vehicle first vehicle system), and so on. The different portions of the data may be non-overlapping portions in that no data included in one portion of the data also is included in another portion of the data. Alternatively, at least some of the data in one portion also is included in another portion of the data. The different portions of the data may be non-overlapping portions in that no data included in one portion of the data also is included in another portion of the data. Alternatively, at least some of the data in one portion also is included in another portion of the data.

The wayside device can communicate the data to vehicle systems only after identifying and confirming the identity of the vehicle systems in one example. For example, the wayside device may only communicate the data to vehicle systems owned or operated by the same company, entity, or the like, which operates the wayside device, to vehicle systems that are designated subscribers to receive the data (e.g., have previously signed up or otherwise indicated a desire to receive the data), etc. The identity of the vehicle systems may be communicated to the wayside device, and the wayside device can determine (based on stored identities in the data recorder) whether a vehicle system is or is not permitted to receive the data. The wayside device may then communicate (or not communicate) the data to the permitted vehicle systems.

The wayside device optionally may include a signal device 134 that can indicate a state or condition of the wayside equipment. For example, the signal device may be one or more lamps that generate one or more lights to indicate whether the wayside equipment is operating as expected (e.g., generate a green light), is operating with one or more faults (e.g., generate a yellow light), or is not operating (e.g., generate a red light). The vehicle system may include a sensor 136 that can detect the indicator generated by the signal device. For example, the sensor may be a camera, radio frequency (RF) sensor, photovoltaic cell, or the like, which can sense whether a lamp is activated by the wayside device and/or the color of the light generated by the lamp of the wayside device. This can permit the vehicle system to communicate the status of the wayside device to the remote system.

In one embodiment, the monitoring system may have a local data collection system deployed in the remote system that may use machine learning to enable derivation-based learning outcomes. The remote system may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the remote system may represent or include a policy engine that may apply one or more policies. These policies may be based at least in part on characteristics of a given item of equipment or environment. With respect to control policies, a neural network can receive input of a number of environmental and task-related parameters. These parameters may include the data obtained from the wayside device, such as identifications of vehicles approaching and/or passing the wayside device, times at which the vehicles were identified, times at which the wayside device changed state or condition, times at which a fault or failure of the wayside equipment was detected, etc.

The neural network may be included in the remote system (and can be represented by the remote system shown in FIG. 1) and can be trained to generate an output based on these inputs, with the output representing an action or sequence of actions that the vehicle systems, remote system, and/or wayside device should take. For example, the neural network can direct or send signals to remotely control one or more of the vehicle systems (e.g., to change routes to avoid faulty or failed wayside equipment, to slow down to permit an operator to travel to and/or repair the wayside device, etc.), to remotely control the wayside device (e.g., to change a state or condition of the wayside equipment), to direct an operator to travel to and repair or inspect the wayside device, etc. During operation of one embodiment, a determination can occur by processing the inputs through the parameters of the neural network to generate a value at the output node designating that action as the desired action. This action may translate into a signal that causes the remote system, wayside device, and/or vehicle system to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The monitoring system may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the remote system executes that plan to achieve the desired input data to mirror the predicted best outcome scenario. Additionally, the success metric may be a combination of the optimized outcomes, which may be weighed relative to each other.

The monitoring system can use this artificial intelligence or machine learning to receive input (e.g., wayside device data), use a model that associates locations with different operating modes to select an operating mode or change in state/condition of the wayside device, and then provide an output (e.g., the change in operation of the wayside device and/or vehicle system using the model). The monitoring system may receive additional input of the change in operating mode that was selected, such as analysis of noise or interference in communication signals (or a lack thereof), operator input, or the like, which indicates whether the machine-selected operating mode provided a desirable outcome or not. Based on this additional input, the controller can change the model, such as by changing which operating mode would be selected when a similar or identical location or change in location is received the next time or iteration. The controller can then use the changed or updated model again to select an operating mode, receive feedback on the selected operating mode, change or update the model again, etc., in additional iterations to repeatedly improve or change the model using artificial intelligence or machine learning.

Figure 2:
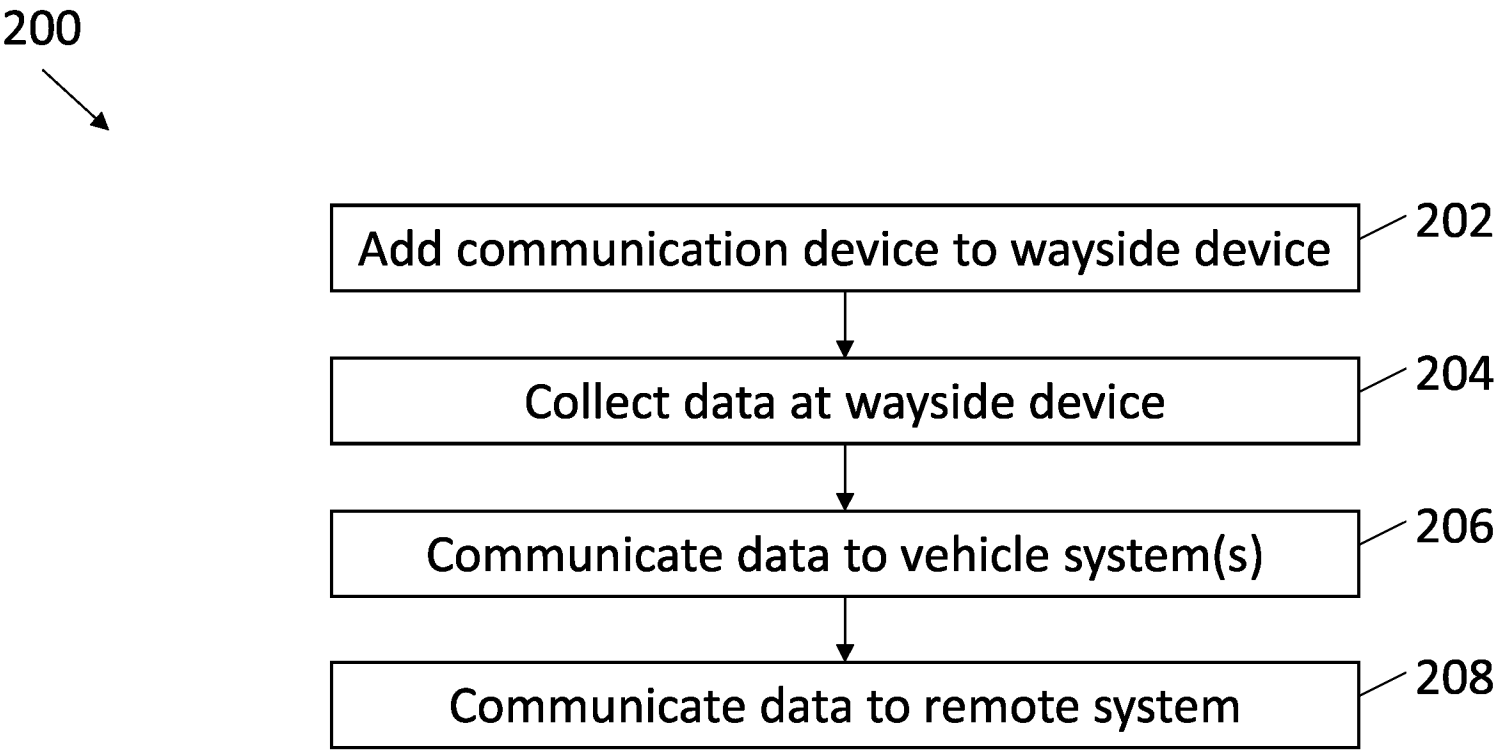
FIG. 2 illustrates a flowchart of one example of a method for monitoring operation of a wayside device.

FIG. 2 illustrates a flowchart of one embodiment of a method 200 for monitoring operation of a wayside device. The method can represent operations performed to monitor the wayside device shown in FIG. 1 or another wayside device. At step 202, a communication device is added to a wayside device. For example, a WiFi access point or another device capable of communicating data with a vehicle system passing by the wayside device may be connected (e.g., via one or more wires or other conductive pathways) with the wayside device (e.g., with a data recorder of the wayside device). At step 204, data is collected by the wayside device indicative of operation of the wayside equipment and/or passage of vehicle systems by the wayside device. At step 206, this data is communicated to one or more vehicle systems. The data can be communicated while the vehicle system(s) is or are moving by the wayside device. For example, during movement of the vehicle system by the wayside device, the communication device of the wayside device may wirelessly communicate the wayside device data to the vehicle system(s). At step 208, this data may be communicated from the vehicle system(s) to the remote system. For example, the vehicle system may wirelessly send the data to a back office of a PTC system for use by the PTC system in evaluating functionality of the wayside device. The remote system can use this data to determine that a wayside device is not functioning and, as a result, change how one or more other vehicle systems are limited in movements. For example, the remote system can communicate movement authorities or restrictions that restrict how and/or when vehicle systems can travel in different segments of a network of interconnected routes. These authorities or restrictions may prevent from vehicle systems entering or passing the wayside devices, may increase separation distances between vehicle systems, can prevent vehicle systems from entering an intersection too closely together in time, etc., based on the identification of how a wayside device is or is not operating.

In one example, a wayside device monitoring system is provided that may include wayside equipment control movement of vehicle systems through a segment of a route and/or monitor operation of the vehicle systems. The wayside equipment can record data indicative of controlling movement of the vehicle systems and/or monitoring operation of the vehicle systems. The monitoring system also can include a communication device coupled with the wayside equipment. The communication device can communicate the data recorded by the wayside equipment to at least one of the vehicle systems as the at least one of the vehicle systems move by the wayside equipment.

The communication device may communicate the data to a remote system that remotely restricts movement of the vehicle system by communicating the data to the at least one of the vehicle systems. The communication device can be retrofitted to the wayside equipment. The wayside equipment may include a gate that raises or lowers to control access to an intersection. The wayside equipment may record one or more of an identity of one or more of the vehicle systems, a time at which the one or more of the vehicle systems passed the wayside equipment, and/or a time at which the wayside equipment raised or lowered the gate.

The wayside equipment may communicate the data to a remote system via the at least one of the vehicle systems. The wayside equipment can communicate the data to the remote system via the at least one of the vehicle systems while the remote system is outside of a wireless communication range of the communication device. The communication device may wirelessly communicate different portions of the data to different ones of the vehicle systems as the vehicle systems move by the communication device.

In another example, a method for monitoring operation of a wayside device is provided. The method may include recording data obtained by wayside equipment (of the wayside device) that one or more of controls movement of vehicle systems through a segment of a route and/or monitors operation of the vehicle systems. The data that is recorded can indicate controlling movement of the vehicle systems and/or monitoring operation of the vehicle systems. The method also may include communicating the data recorded by the wayside equipment to at least one of the vehicle systems as the at least one of the vehicle systems move by the wayside equipment.

The data may be communicated to the at least one of the vehicle systems for communication to a remote system that remotely restricts movement of the vehicle system by communicating the data to the at least one of the vehicle systems. The method also can include retrofitting a communication device to the wayside equipment. The data may be communicated to the at least one of the vehicle systems using the communication device. The data that is recorded may be associated with (e.g., generated in response to) raising and/or lowering a gate to control access to an intersection. The data may include one or more of an identity of one or more of the vehicle systems, a time at which the one or more of the vehicle systems passed the wayside equipment, and/or a time at which the wayside equipment raised or lowered the gate.

The method also may include communicating the data from the at least one of the vehicle systems to a remote system. The data can be communicated to the remote system via the at least one of the vehicle systems while the remote system is outside of a wireless communication range of the communication device. The data may be communicated by wirelessly communicating different portions of the data to different ones of the vehicle systems as the vehicle systems move by the communication device.

In another example, a wayside device is provided that may include a gate that can be raised or lowered to control access of vehicle systems to move through an intersection between routes, a data recorder that may store data indicative of times at which the gate is raised or lowered, and a communication device that may wirelessly communicate the data to a remotely located PTC back office system by wirelessly communicating the data to at least one of the vehicle systems while the at least one of the vehicle systems moves through the intersection.

The communication device may be retrofitted to the wayside device. The communication device can communicate different portions of the data to different ones of the vehicle systems. The communication device may wirelessly communicate the data to the at least one of the vehicle systems subsequent to determining an identity of the at least one of the vehicle systems.

Use of phrases such as "one or more of . . . and," "one or more of . . . or," "at least one of . . . and," and "at least one of . . . or" are meant to encompass including only a single one of the items used in connection with the phrase, at least one of each one of the items used in connection with the phrase, or multiple ones of any or each of the items used in connection with the phrase. For example, "one or more of A, B, and C," "one or more of A, B, or C," "at least one of A, B, and C," and "at least one of A, B, or C" each can mean (1) at least one A, (2) at least one B, (3) at least one C, (4) at least one A and at least one B, (5) at least one A, at least one B, and at least one C, (6) at least one B and at least one C, or (7) at least one A and at least one C.

As used herein, an element or step recited in the singular and preceded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function devoid of further structure.

This written description uses examples to disclose several embodiments of the subject matter, including the best mode, and to enable one of ordinary skill in the art to practice the embodiments of subject matter, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system, comprising:

wayside equipment configured to control movement of vehicle systems through a segment of a route, the wayside equipment configured to record data indicative of the movement that is controlled or the operation that is monitored, the wayside equipment configured to determine an identity of the vehicle systems, and based on the identity of the vehicle systems, the wayside equipment is configured to determine whether the vehicle systems are permitted to receive the data; and a communication device coupled with the wayside equipment, the communication device configured to communicate, upon the vehicle systems being permitted to receive the data, the data recorded by the wayside equipment to at least one of the vehicle systems as the at least one of the vehicle systems move by the wayside equipment.

2. The system of claim 1, wherein the communication device is configured to communicate the data to a remote system that remotely restricts movement of the vehicle system by communicating the data to the at least one of the vehicle systems.

3. The system of claim 1, wherein the communication device is configured to be retrofitted to the wayside equipment.

4. The system of claim 1, wherein the wayside equipment includes a gate that raises or lowers to control access to an intersection.

5. The system of claim 4, wherein the wayside equipment is configured to record one or more of an identity of one or more of the vehicle systems, a time at which the one or more of the vehicle systems passed the wayside equipment, or a time at which the wayside equipment raised or lowered the gate.

6. The system of claim 1, wherein the wayside equipment is configured to communicate the data to a remote system via the at least one of the vehicle systems.

7. The system of claim 6, wherein the wayside equipment is configured to communicate the data to the remote system via the at least one of the vehicle systems while the remote system is outside of a wireless communication range of the communication device.

8. The system of claim 1, wherein the communication device is configured to wirelessly communicate different portions of the data to different ones of the vehicle systems as the vehicle systems move by the communication device.

9. A method, comprising:

controlling movement of vehicle systems through a segment of a route by raising or lowering a gate;

recording data obtained by wayside equipment that one or more of controls movement of vehicle systems through a segment of a route or monitors operation of the vehicle systems, the data that is recorded indicative of the movement that is controlled or the operation that is monitored;

determining an identity of the vehicle systems;

based on the identity of the vehicle systems, determining whether the vehicle systems are permitted to receive the data; and communicating, upon the vehicle systems being permitted to receive the data, the data recorded by the wayside equipment to at least one of the vehicle systems as the at least one of the vehicle systems move by the wayside equipment.

10. The method of claim 9, wherein the data is communicated to the at least one of the vehicle systems for communication to a remote system that remotely restricts movement of the vehicle system by communicating the data to the at least one of the vehicle systems.

11. The method of claim 9, further comprising retrofitting a communication device to the wayside equipment, wherein the data is communicated to the at least one of the vehicle systems using the communication device.

12. The method of claim 9, wherein the data that is recorded is associated with raising or lowering a gate to control access to an intersection.

13. The method of claim 12, wherein the data includes one or more of an identity of one or more of the vehicle systems, a time at which the one or more of the vehicle systems passed the wayside equipment, or a time at which the wayside equipment raised or lowered the gate.

14. The method of claim 9, further comprising communicating the data from the at least one of the vehicle systems to a remote system.

15. The method of claim 14, wherein the data is communicated to the remote system via the at least one of the vehicle systems while the remote system is outside of a wireless communication range of a communication device.

16. The method of claim 9, wherein the data is communicated by wirelessly communicating different portions of the data to different ones of the vehicle systems as the vehicle systems move by a communication device.

17. A wayside device, comprising:

a gate configured to be raised or lowered to control access of vehicle systems to move through an intersection between routes;

a data recorder configured to store data indicative of times at which the gate is raised or lowered; and a communication device configured to wirelessly communicate the data to a remotely located positive train control (PTC) back office system by wirelessly communicating the data to at least one of the vehicle systems while the at least one of the vehicle systems moves through the intersection.

18. The wayside device of claim 17, wherein the communication device is retrofitted to the wayside device.

19. The wayside device of claim 17, wherein the communication device is configured to communicate different portions of the data to different ones of the vehicle systems.

20. The wayside device of claim 17, wherein the communication device is configured to wirelessly communicate the data to the at least one of the vehicle systems subsequent to determining an identity of the at least one of the vehicle systems.

* * * * *